US007186941B2

(12) United States Patent
Yeon

(10) Patent No.: US 7,186,941 B2
(45) Date of Patent: Mar. 6, 2007

(54) ARC EXTINGUISHER ASSEMBLY FOR MOLDED CASE CIRCUIT BREAKER

(75) Inventor: Young-Myoung Yeon, Chungcheongbuk-Do (KR)

(73) Assignee: LS Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 11/252,604

(22) Filed: Oct. 19, 2005

(65) Prior Publication Data

US 2006/0086693 A1 Apr. 27, 2006

(30) Foreign Application Priority Data

Oct. 21, 2004 (KR) ..... 10-2004-0084563

(51) Int. Cl.
*H01H 9/30* (2006.01)

(52) U.S. Cl. ..... 218/38; 218/15; 218/149

(58) Field of Classification Search ..... 218/15, 218/34, 35–38, 149–151, 156–158; 335/201
See application file for complete search history.

(56) References Cited

U.S. PATENT DOCUMENTS

| | | | | |
|---|---|---|---|---|
| 5,463,199 | A * | 10/1995 | Divincenzo et al. | 218/158 |
| 5,589,672 | A * | 12/1996 | Uchida et al. | 218/34 |
| 6,248,970 | B1 * | 6/2001 | DiMarco et al. | 218/149 |
| 6,297,465 | B1 * | 10/2001 | Groves et al. | 218/156 |
| 6,700,087 | B2 * | 3/2004 | Rademacher et al. | 218/149 |
| 6,825,431 | B2 * | 11/2004 | Azzola et al. | 218/156 |
| 7,034,242 | B1 * | 4/2006 | Shea et al. | 218/157 |

FOREIGN PATENT DOCUMENTS

| | | |
|---|---|---|
| JP | 9-171761 | 6/1997 |
| KR | 10-2004-0038886 | 5/2004 |

OTHER PUBLICATIONS

English Langue abstract of JP 9-171761.
English Langue abstract of KOREAN 10-2004-0038886.

* cited by examiner

*Primary Examiner*—Elvin Enad
*Assistant Examiner*—M. Fishman
(74) *Attorney, Agent, or Firm*—Greenblum & Bernstein, P.L.C.

(57) ABSTRACT

An arc extinguisher assembly is provided for a mould cased circuit breaker capable of reducing time for arc extinguishing and preventing contacts from being damaged due to a back flow of an arc. To this end, the arc extinguisher assembly for a mould cased circuit breaker provided with a fixed contactor and a movable contactor in the case, includes a plurality of grids made of a ferro magnetic material, each having a recess portion for allowing a movement of the movable contactor, laminated to surround contacts of the movable contactor and the fixed contactor and installed in the case, for dividing an arc when the arc is generated between the fixed contactor and the movable contactor, and a grid support plate including outer wall portions supporting the grids and inner wall portions provided adjacent to contacts of the movable contactor and the fixed contactor and compressing an arc to be narrow, the grid support plate being installed to have a U-shaped horizontal section with an aperture facing the opposite side of the contacts.

7 Claims, 4 Drawing Sheets

ARC EXTINGUISHER ASSEMBLY FOR MOLDED CASE CIRCUIT BREAKER

BACKGROUND OF THE INVENTION

1. Field of the Invention

The present invention relates to a molded case circuit breaker, and particularly, to an arc extinguisher assembly for a molded case circuit breaker capable of improving current limiting performance by speedily cooling an arc generated in a procedure where the breaker interrupts an electric shortage current when a short circuit occurs.

2. Description of the Conventional Art

A molded case circuit breaker is an electrical device that protects a circuit and a load by automatically opening the circuit against an excess current such as an electric shortage current. A molded case circuit breaker that has an excellent arc extinguishing capability and can interrupt a current within a short period of time is considered to be the one with good current limiting performance.

Referring to FIGS. 1 to 4, an arc extinguisher assembly in accordance with the conventional art will now be described.

First, the construction of the molded case circuit breaker provided with the conventional arc extinguisher assembly will now be described with reference to FIG. 1 that illustrates a longitudinal sectional view thereof. The conventional molded case circuit breaker 100 includes a first fixed contactor 141 formed of a conductor and having a terminal portion connected to power source or an electrical load, and a movable contactor 142 being rotatively movable to a position where it comes in contact with the first fixed contactor 141 (hereinafter, referred to as a contacted position) or a position where it is separated from the first fixed contactor 141 (hereinafter, referred to as a separated position). The arc extinguisher assembly 140 for extinguishing an arc in accordance with the conventional art is installed to surround a contact portion between the first fixed contactor 141 and the movable contactor 142. In FIG. 1, reference numeral 150 designates a holder that rotatably supports the movable contactor 142, and reference numeral 120 designates a switching mechanism that rotatively drives the movable contactor 142 to the contacted position or the separated position. A second fixed contactor 160 is connected to the movable contactor 142 by an electrical conductor (not shown) and has at its one end portion, a terminal portion connected to power source or an electrical load. Reference numeral 170 represents a trip mechanism for triggering the switching mechanism 120 to operate to a trip position when a current flowing through the second fixed contactor 160 is an excessive current such as an electric shortage current. Reference numeral 180 represents a handle connected to the switching mechanism 120, for manually moving the movable contactor 142 to the contacted position or the separated position.

The detailed construction of the arc extinguisher assembly, the case, and the fixed and movable contactors in accordance with the conventional art, which are built in the molded case circuit breaker, will now be described with reference to FIG. 2.

FIG. 2 is an exploded perspective view that illustrates the arc extinguisher assembly, a portion of the case receiving the assembly, the fixed contactor and the movable contactor of FIG. 1 in detail.

The arc extinguisher assembly 143 is installed to surround contacts 141*a* and 142*a* of the fixed contactor 141 and the movable contactor 142. The arc extinguisher assembly 143 includes a plurality of plates 143*a* made of metal of a ferro magnetic material, an uppermost plate 144, and a support plate 143*b* made of an electrically insulated material and for supporting the plates 143*a*.

The fixed contactor 141 is a current-limiting type one which is bent in a U-shape, and a fixed contact 141*a* is attached onto one end portion of the fixed contactor 141 by way of welding or the like. An arc runner 141*b* for inducing an arc is attached behind the fixed contact 141*a* on an upper portion of the fixed contactor 141.

In the drawing, the case 145 illustrated with deviant lines represents a portion of a case and a cover, which receives the arc extinguisher assembly, and is made by molding a synthetic resin having an electrical insulation property.

The arc extinguishing operation of the arc extinguisher assembly for a molded case circuit breaker in accordance with the conventional art will now be described with reference to FIGS. 3 and 4. FIG. 3 is a perspective view for describing the arc extinguishing operation by the arc extinguisher assembly of FIG. 1, and FIG. 4 is a view for describing moving directions of an arc in order to show a moving path of an arc in the arc extinguisher assembly of FIG. 3.

If an abnormal current such as an excessive current and an electric shortage current is generated in an electrical circuit in a state that the fixed contact 141*a* and the movable contact 142*a* are electrically connected, the movable contactor 142 is rotated to be separated from the fixed contactor 141 by an electro magnetic repulsive force created between the fixed contact 141*a* and the movable contact 142*a*, thereby opening the circuit.

When the movable contactor 142 is separated from the fixed contactor 141, an arc occurs between the fixed contact 141*a* and the movable contact 142*a*, and the arc generated thereby is induced to the arc runner 141*b* (refer to FIG. 2). Then, as shown in FIG. 4, some arc (a, b and c) moves toward the arc extinguisher assembly 143 and the rest flows back toward the contacts 141*a* and 142*a*.

Then, the arc is divided and cooled by the plates 143*a* of the arc extinguisher assembly 143, thereby being extinguished. An arc gas formed as the air around the arc is heated is discharged to the outside of the molded case circuit breaker through an discharge hole 146 of FIG. 3.

However, in the conventional arc extinguisher assembly for a molded case circuit breaker, a column of the arc cannot be compressed and extended, and the arc is extinguished only by the effects of dividing and cooling by the plurality of laminated plates 143*a*. Thusly, it takes a long time to complete such extinguishing. Also, an arc may reoccur or the contacts 141*a* and 142*a* are damaged by a back flow of an arc and a gas around the arc toward the contacts 141*a* and 142*a*.

BRIEF DESCRIPTION OF THE INVENTION

Therefore, an object of the present invention is to provide an arc extinguisher assembly for a molded case circuit breaker capable of reducing time for arc extinguishing and preventing contacts from being damaged by repressing a back flow of an arc.

To achieve these and other advantages and in accordance with the purpose of the present invention, as embodied and broadly described herein, there is provided an arc extinguisher assembly for a molded case circuit breaker provided with an electrically insulated case, a fixed contactor and a movable contactor in the case, the assembly comprising a plurality of plates made of a ferro magnetic material, each having a recess portion for allowing a movement of the movable contactor, laminated to surround contacts of the movable contactor and the fixed contactor and installed in the case, for dividing an arc when the arc is generated between the fixed contactor and the movable contactor, and a plate support plate including outer wall portions supporting the plates and inner wall portions provided adjacent to contacts of the movable contactor and the fixed contactor and compressing an arc to be narrow, the plate support plate being installed to have a U-shaped horizontal section with an aperture facing the opposite side of the contacts.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Figure 5A:
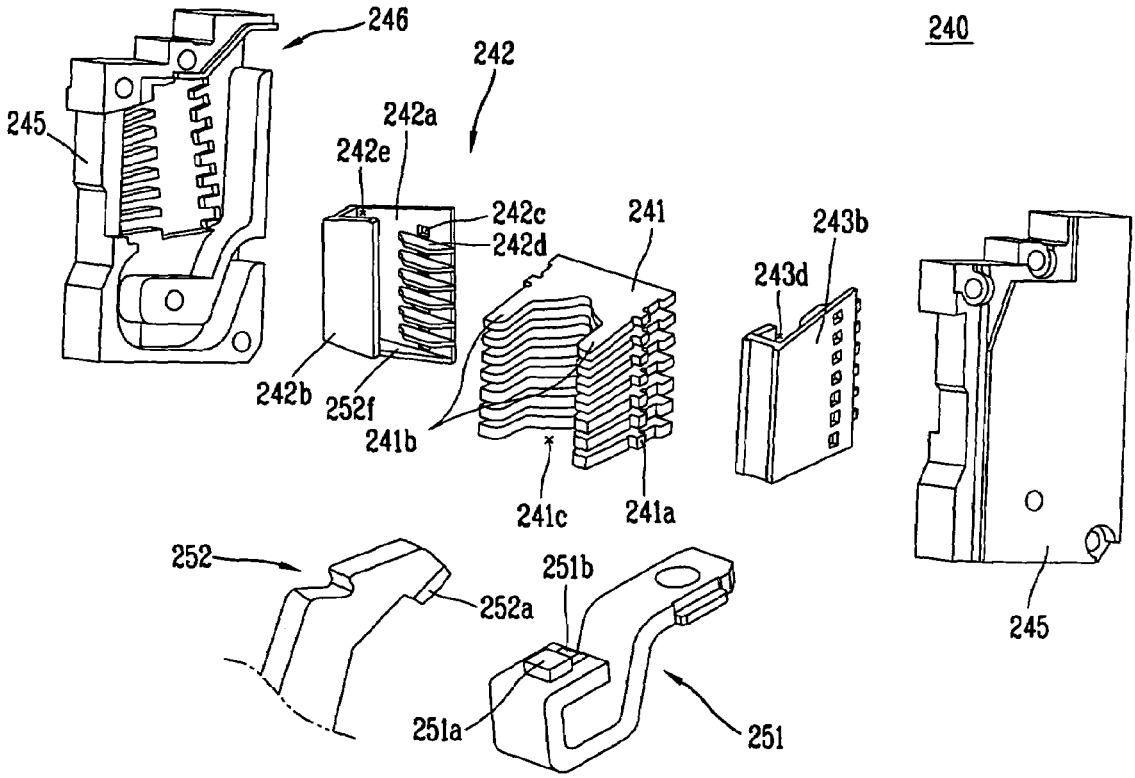
FIG. 5A is an exploded perspective view of the arc extinguisher assembly in accordance with the present invention.
Figure 5B:
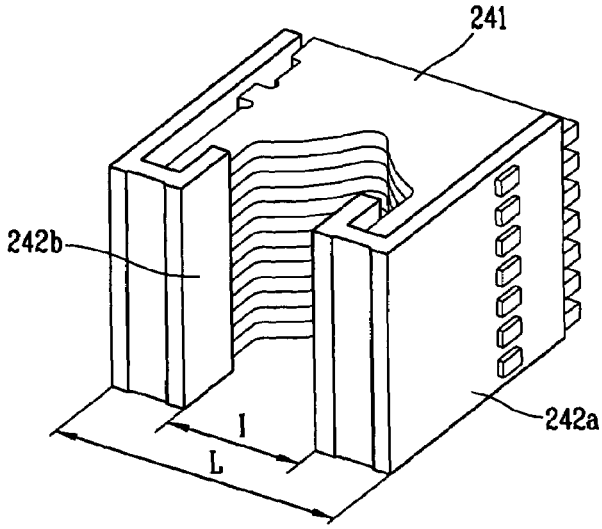
FIG. 5B is an assembled perspective view of the arc extinguisher assembly in accordance with the present invention.
Figure 6:
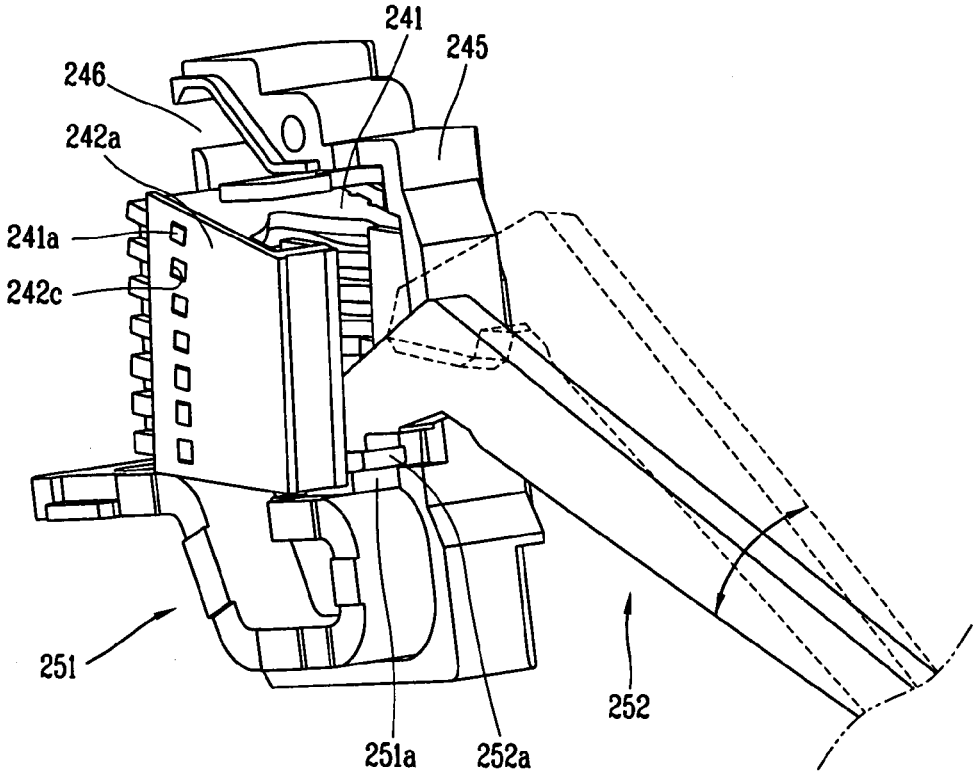
FIG. 6 is a perspective view for describing arc extinguishing operation by the arc extinguishing assembly in accordance with the present invention.

With reference to FIGS. 5A, 5B and 6, the arc extinguisher assembly 240 in accordance with one embodiment of the present invention is suitable to use in a molded case circuit breaker provided with a fixed contactor 251 and a movable contactor 252. The fixed contactor 251 includes a fixed contact 251*a* on its contact surface coming in contact with a contact 252*a* of the movable contactor 252. Reference numeral 241*b* represents an arc runner for inducing an arc at a position adjacent to the fixed contact 251*a*, which is generated by separation between the movable contactor 252 and a fixed contactor 251, toward a plate 241 with an electro magnetic repulsive force when an excess current such as an electric shortage current flows through the contacts 251*a* and 252*a*.

The molded case circuit breaker includes a case 245 made of an electrically insulated material, for receiving the arc extinguisher assembly 240 in accordance with one embodiment of the present invention.

The arc extinguisher assembly 240 in accordance with one embodiment of the present invention includes a plurality of plates 241. Each of the plates 241 is made of a ferro magnetic material and includes a recess portion 241*c* for allowing a rotative movement of the movable contactor 252. A plurality of plates 241 having U-shaped horizontal section are laminated in a vertical direction to surround the contacts 251*a* and 251*b* of the movable contactor 252 and the fixed contactor 251 for the purpose of dividing an arc when the arc is generated between the fixed contactor 251 and the movable contactor 252.

The arc extinguisher assembly 240 in accordance with one embodiment of the present invention includes a pair of plate support plate 242.

Each of the plate support plate 242 includes outer wall portions 242*a* supporting plate 241 and inner wall portions 242*b* each bent and extending from the outer wall portion 242*a* in a U-shape and provided adjacent to the contacts 251*a* and 251*b* of the movable contactor 252 and the fixed contactor 251. Here, the plate support plate 242 has a rough U-shaped horizontal section, and the U-shaped horizontal section of the plate support plate 242 is opened towards the opposite side of the contacts 251*a* and 251*b* so as to support the plates 241 and simultaneously prevent the back flow of the arc toward the contacts 251*a* and 251*b* of the contactors 251 and 252.

Figure 1:
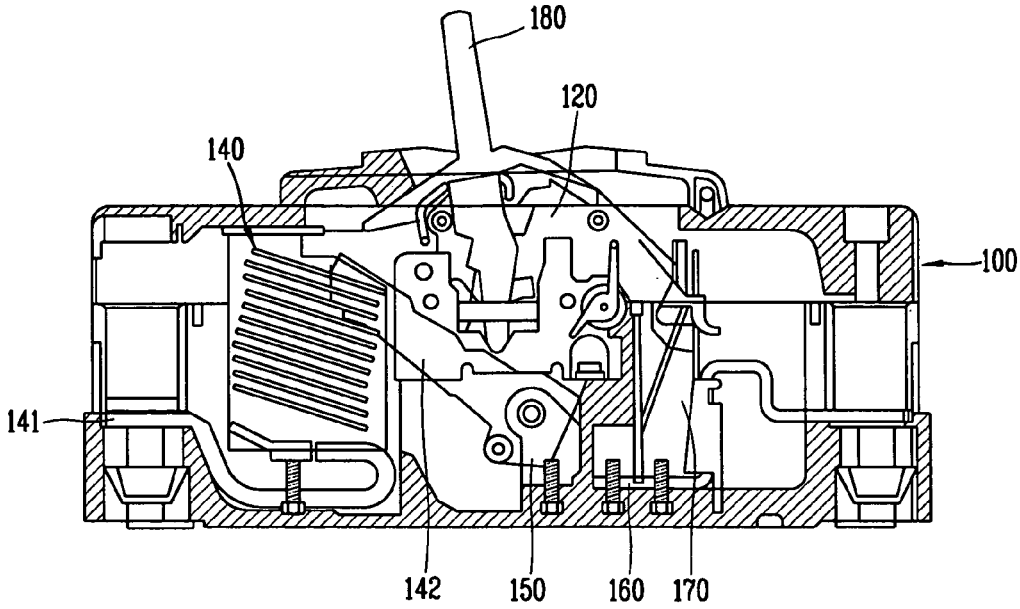
FIG. 1 CONVENTIONAL ART
FIG. 1 is a longitudinal sectional view that illustrates a structure of a mould cased circuit breaker including a conventional arc extinguisher assembly.
Figure 2:
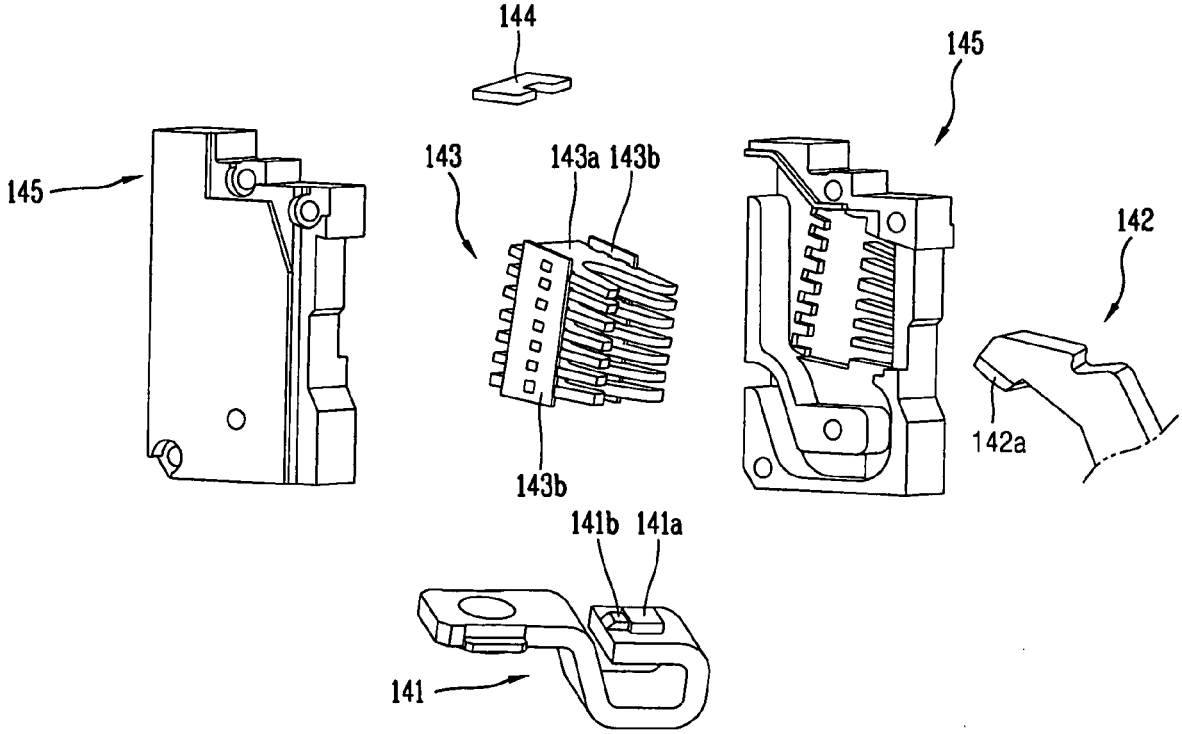
FIG. 2 CONVENTIONAL ART
FIG. 2 is an exploded perspective view that illustrates the arc extinguisher assembly of FIG. 1, a portion of a case receiving the assembly, and a fixed contactor and a movable contactor in detail.
Figure 3:
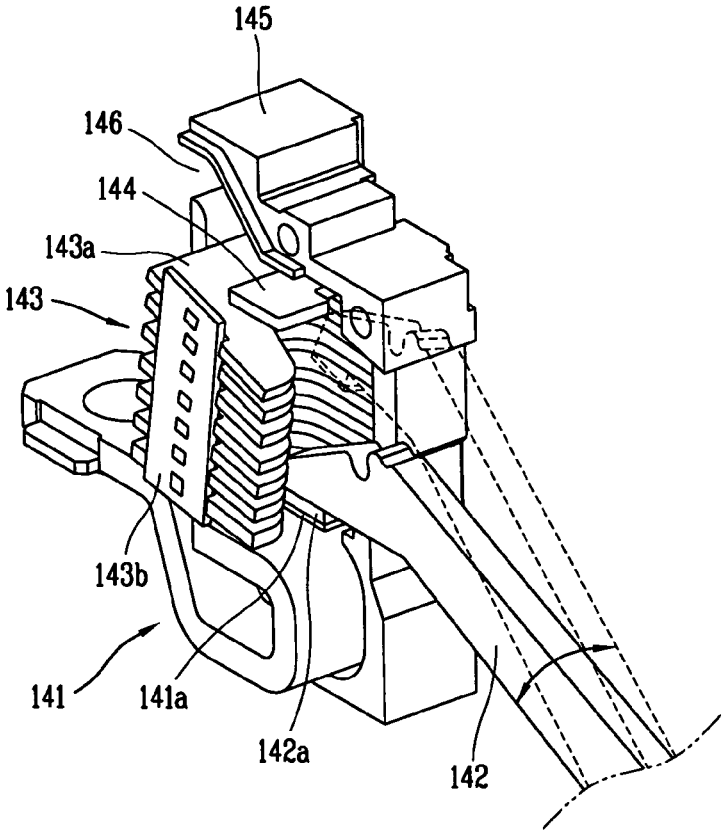
FIG. 3 CONVENTIONAL ART
FIG. 3 is a perspective view that illustrates an arc extinguishing operation of the arc extinguisher assembly of FIG. 1.
Figure 4:
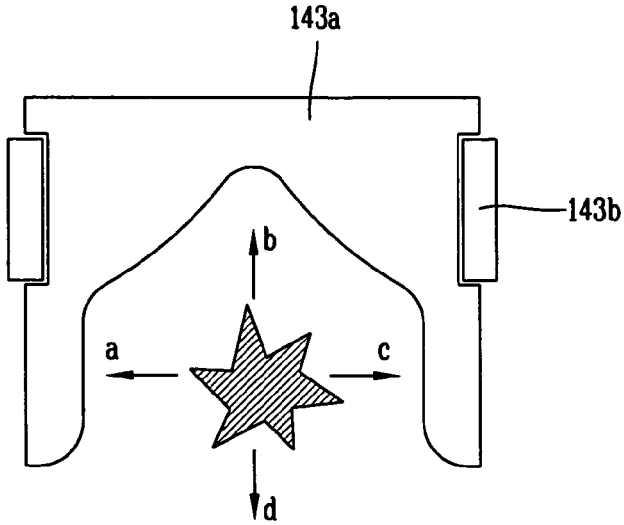
FIG. 4 CONVENTIONAL ART
FIG. 4 is a view that illustrates moving directions of an arc in order to describe a moving path of an arc in the arc extinguisher assembly of FIG. 3.
Figure 7:
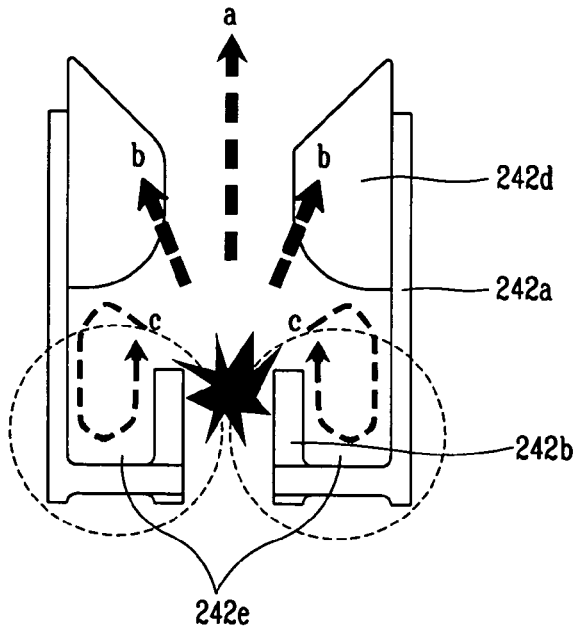
FIG. 7 is a view that illustrates moving directions of an arc in order to describe a moving path of an arc in the arc extinguisher assembly of FIG. 6 in accordance with the present invention.

Two cases 245 may be coupled together as one set by a coupling unit such as a screw or the like. The case 245 receives not only the arc extinguisher assembly 240 but also a switching mechanism (refer to reference numeral 120 of FIG. 1) driving the movable contactor 252, a trip mechanism (refer to reference numeral 170 of FIG. 1) and another fixed contactor (refer to reference numeral 160 of figure 1). In FIGS. 5 to 7, only a portion of the case 245 that receives the arc extinguisher assembly in accordance with the present invention is illustrated, and other portions of the case (a portion extending to the right side from the case 245 of FIG. 5*a*) that receive the switching mechanism, the trip mechanism and another fixed contactor are omitted. The case 245 may be constructed as a single pole unit type case that can be electrically insulated from another case of a different phase (pole) such that each arc extinguisher assembly and each pair of fixed and movable contactors are received in each case according to phases (according to poles). For example, in the case of a breaker for a molded case wire for three-phase AC, three cases of the single pole unit type may be provided, and a container receiving all of those three cases of the signal pole unit type and a cover covering an upper portion of the container may be provided. An exhausting hole 246 for exhausting an arc gas is provided at a predetermined position above the arc extinguisher assembly 240 of the case 245.

The plate support plate 242 is for supporting the plates 241 and includes one pair of outer wall portions 242*a* which are long and face each other. In order to form a chamber 242*e* for preventing a back flow of an arc together with the outer wall portions 242*a*, the plate support plate 242 also includes one pair of inner wall portions 242*b* bent and extending from the outer wall portions 242*a* in a U-shape such that each end portion of its horizontal sectional surface faces the opposite side of the movable contactor. The pair of inner wall portions 242*b* have shorter lengths than those of the outer wall portions 242*a* and face each other. A plurality of connection holes 242*c* for a connection with the plates 241 are provided at a surface of each outer wall portion 242*a* facing the plates 241 in a vertical direction at a predetermined interval, wherein the number of the connection holes 242*c* corresponds to the number of the plates. In the embodiment illustrated in the drawing, seven connection holes 242*c* are provided. A guiding protrusion portion 242*d* for guiding a portion of the plate 241 inserted in the connection hole 242*c* at the time of the connection and installation of the plate 241 is provided right under each connection hole 242*c*.

In order to induce the exhaustion of the arc gas through the exhausting hole 246 of the case 245, an upper end portion of the plate support plate 242 is opened, and a lower end portion thereof is closed with a bottom plate portion 252*f*.

According to the preferred embodiment of the present invention, the plate support plate 242 may be made of Nylon 6, 6 manufactured by DuPont Corporation or Nylon 6 manufactured mainly by Asian textile manufacturers. Even though a temperature of an arc reach up to about 10,000° C., the plate support plate 242 made of Nylon 6, 6 or Nylon 6 is not melt or weakened by the arc because the arc is extremely momentarily extinguished (the arc is extinguished within about 3 milli seconds in consideration of performance that the molded case circuit breaker is required to have). The present inventor considered POM(Poly Oxy Methylene), which forms a hydrogen gas when being momentarily heated by an arc, to be a material of the support plate 242. The melting point of POM(Poly Oxy Methylene) is 180° C., the melting point of Nylon 6 is 210° C., and the melting point of Nylon 6, 6 is 250° C. The temperature around the contacts reached up to 120~130° C. at the time of current limiting operation using the electro magnetic repulsive force, and therefore, the POM having melting point of 180° C. is at least weakened and might collapse, failing to support the plate. For this reason, the inventor decided that the POM was not appropriate as the material of the plate support plate 242. In that point of view, the most preferred material would be Nylon 6, 6.

When being heated instantly by an arc, the Nylon 6, 6 or Nylon 6 discharges a hydrogen gas, including other gases like carbon. Because the hydrogen gas is the lightest gas on the planet, the hydrogen gas ascends in an instant along a space between two arm portions 241*b* of the plate and is exhausted through the exhausting hole 246 placed at an upper portion of the arc extinguisher assembly 240 of the present invention. For this reason, the hydrogen gas is used to induce the extinguishing of the arc.

When an excessive current such as an electric shortage current is accidentally generated on a circuit where a molded case circuit breaker is installed, as shown in FIG. 6, the movable contactor 252 is rotated to be separated from the fixed contactor 251 by an electro magnetic repulsive force between the contact 252*a* of the movable contactor 252 and the contact 251 a of the fixed contactor 251. Also, an arc occurs between the contact 252*a* of the movable contactor 252 and the contact 251*a* of the fixed contactor 251. As shown in FIG. 5B, a distance (I) between the inner wall portions 242*b* formed as a pair and facing each other is shorter than a distance (L) between the facing outer wall portions 242*a* formed as a pair. Accordingly, when generated between the inner wall portions 242*b*, the arc is compressed at a narrow gap between the pair of inner wall portions 242*b* and becomes long and narrow. The arc is generated from the contact 251*a* of the fixed contactor 251 in a vertical direction by the movable contactor 252 rotated by the electro magnetic repulsive force, and, at that moment, the inner wall portions 242*b* of Nylon 6 or Nylon 6, 6 emits a hydrogen gas by the momentary heating of the arc.

Accordingly, the arc is compressed further to be narrower and longer at the narrow gap between the pair of inner wall portions 242*b* by the pressure of the hydrogen gas emitted from the inner wall portions 242*b*. An arc gas including the hydrogen gas, the arc and the ambient air heated by the arc is introduced to a space between the two arm portions 241*b* where the pressure is lower than that within the gap between the pair of inner wall portions 242*b*. Here, an electro magnetic absorption force that is created from the plate 241 made of a ferro magnetic material also helps such introduction of the arc. The arc among those (the arc, the hydrogen gas and the arc gas) introduced in such a manner is divided and cooled by the plurality of plates 241 that are laminated, and the hydrogen gas and the arc gas ascend along the space between the two arm portions 241*b* and are exhausted through the exhausting hole 246 placed at an upper portion of the arc extinguisher assembly 240.

As shown in FIG. 5A, each plate 241 is a metal plate made of a ferro magnetic material. As for such a plate 241, connection protrusion portions 241*a* inserted in the connection hole 242*c* of the plate support plate 242 are provided at both sides, a recess portion 241*c* for allowing a movement of the movable contactor 252 is provided, and two arm portions 241*b* are provided to surround the contacts 251*a* and 251*b* of the movable contactor 252 and the fixed contactor 251.

As shown in FIG. 7, the generated arc is introduced in directions of arrows a, b, c by the pressure difference between the space between both inner wall portions 242*b* of the plate support plate 242 and the space of recess portion 241*c* and by the electro magnetic absorption force from the plate 241. Here, an arc indicated as the arrow a is introduced toward the recess portion 241*c* of the plate 241, an arc indicated as the arrow b is introduced toward the guiding protrusion 242*b* of the plate support plate 242, and an arc indicated as the arrow c is introduced toward the two arm portions 241*b* of the plate 241 and flows back toward the contacts 251*a* and 252*a*. However, as shown in FIG. 7, because the arc extinguisher assembly in accordance with the present invention has the plate support plate with a u-shaped horizontal section opened towards the opposite side of the contacts 251*a* and 252*a*, the arc which is flowing back is introduced toward the guiding protrusion portion 242*d* of the plate 241 again. Accordingly, phenomena can be prevented that an arc is regenerated at the contacts 251*a* and 252*a* of the contactors 251 and 252 by the arc flowing back toward the contacts 251*a* and 252*a* or that the contacts 251*a* and 252*a* are damaged by the arc. As shown in FIG. 7, reference numeral 242*e* represents a reverse exhaustion preventing chamber 242*e* for converting the direction of an arc that is flowing reversely toward the plate 241.

As described so far, by the arc extinguisher assembly for the molded case circuit breaker in accordance with one embodiment of the present invention, a generated arc is compressed to be long and narrow at a narrow gap between the two inner wall portions of the plate support plate, and is introduced to a plurality of plates laminated in a vertical direction, thereby being divided and cooled. Consequently, the arc can be speedily exhausted.

Also, the back flow of the arc toward the contacts is interrupted to prevent reoccurrence of the arc and the durability of the molded case circuit breaker can be improved as damage to the contacts is prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. An arc extinguisher assembly for a molded case circuit breaker provided with an electrically insulated case, a fixed contactor and a movable contactor in the case, the assembly comprising:

a plurality of plates made of a ferro magnetic material, each having a recess portion that allows a movement of the movable contactor, laminated to surround contacts of the movable contactor and the fixed contactor and installed in the case, to drive an arc when the arc is generated between the fixed contactor and the movable contactor; and a pair of plate support plates including outer wall portions to support the plates and inner wall portions provided adjacent to contacts of the movable contactor and the fixed contactor to compress an arc to be narrow, the plate support plates being installed to have a U-shaped horizontal section opened towards an opposite side of the contacts, wherein the outer wall portions of the plate support plates include connection holes formed therein, a guiding protrusion portion that guides a portion of a plate that is inserted in a connection hole being provided directly under each connection hole.

2. The assembly of claim 1, wherein an exhausting hole for exhaustion of an arc gas is provided at a predetermined position on the case above the arc extinguisher assembly; and an upper end portion of the plate support plate is opened and an lower end portion thereof is closed with a bottom plate in order to induce the exhaustion of the arc gas through the exhausting hole.

3. The assembly of claim 1, wherein the plate support plate is made of Nylon 6, 6 or Nylon 6.

4. The assembly of claim 1, wherein the pair of outer wall portions have a long length and face each other to support the plate; and the pair of inner wall portions face each other to form a chamber together with the outer wall portions to prevent a back flow of an arc, bent in a U-shape and extending from the outer wall portions with end portions of their horizontal sections facing the opposite side of the movable contactor.

5. The assembly of claim 4, wherein a distance between the pair of inner wall portions is shorter than a distance between the pair of outer wall portion, so that when an arc is generated, a column of the arc can be compressed to be narrow and long.

6. The assembly of claim 4, wherein free end portions of two arms of the plate are received in the chamber to prevent a back flow of the arc.

7. The assembly of claim 4, wherein the connection holes are provided on a surface of each outer wall portion facing the plates in a vertical direction at a predetermined interval, the number of connection holes corresponding to the number of plates.

* * * * *